US008340336B1

(12) United States Patent
Frerking et al.

(10) Patent No.: US 8,340,336 B1
(45) Date of Patent: Dec. 25, 2012

(54) MAGNETIC COUPLING ENHANCED SPEAKER ASSEMBLY

(75) Inventors: Melvin Duane Frerking, Norcross, GA (US); George O'Quinn Hirvela, Carrollton, GA (US)

(73) Assignee: AT&T Mobility II LLC, Atlanta, GA (US)

( * ) Notice: Subject to any disclaimer, the term of this patent is extended or adjusted under 35 U.S.C. 154(b) by 1359 days.

(21) Appl. No.: 11/626,423

(22) Filed: Jan. 24, 2007

Related U.S. Application Data

(60) Provisional application No. 60/761,876, filed on Jan. 25, 2006.

(51) Int. Cl.
*H04R 25/00* (2006.01)

(52) U.S. Cl. ..... 381/331; 381/396; 381/401; 379/443

(58) Field of Classification Search ..... 381/312, 381/315, 322, 331, 401, 396, 400, 402, 406; 379/52, 55.1, 443, 444; 455/41.1
See application file for complete search history.

(56) References Cited

U.S. PATENT DOCUMENTS

| | | | | |
|---|---|---|---|---|
| 3,129,298 | A * | 4/1964 | Wytze Hofman | 381/189 |
| 5,440,630 | A * | 8/1995 | Yamaguchi et al. | 379/437 |
| 5,487,114 | A * | 1/1996 | Dinh | 381/406 |
| 5,557,673 | A * | 9/1996 | Ginzburg | 379/443 |
| 5,715,324 | A * | 2/1998 | Tanabe et al. | 381/412 |
| 6,611,605 | B2 * | 8/2003 | Kim | 381/406 |
| 7,657,049 | B2 * | 2/2010 | Waldron et al. | 381/331 |
| 2001/0055386 | A1 * | 12/2001 | Waldron et al. | 379/444 |
| 2004/0258261 | A1 * | 12/2004 | Cochran et al. | 381/315 |

OTHER PUBLICATIONS

Kozma-Spytek, L., "Hearing aid compatible telephones: history and current status," Seminars in Hearing, 2003m 24(1), 17-28.

Teder, H., "Quantifying telecoil performance: understanding historical and current ANSI standards," Seminars in Hearing, 2003, 24(1), 63-70.

Yanz, J.L., et al., "Telecoils: principles, pitfalls, fixes, and the future," Seminars in Hearing, 2003, 24(1), 29-41.

* cited by examiner

*Primary Examiner* — Huyen D Le
(74) *Attorney, Agent, or Firm* — Woodcock Washburn LLP

(57) ABSTRACT

A speaker assembly, a method for manufacturing a speaker assembly and a wireless device are provided. Such a speaker assembly may include a diaphragm for generating sound, a transducer for causing the diaphragm to generate sound and an integrated inductive element that is electrically connected to the transducer. The diaphragm, transducer and integrated inductive element are contained within the speaker assembly.

16 Claims, 12 Drawing Sheets

MAGNETIC COUPLING ENHANCED SPEAKER ASSEMBLY

CROSS REFERENCE TO RELATED APPLICATION

This application claims priority under 35 U.S.C. §119(e) from U.S. Provisional Patent Application No. 60/761,876, filed Jan. 25, 2006, entitled "Magnetic Coupling Enhanced Speaker Assembly." The above-listed U.S. Provisional Patent Application is incorporated by reference herein, in its entirety, for all purposes.

BACKGROUND

A telecoil is a tightly wrapped piece of wire with sensitivity to magnetic flux. When a telecoil is installed in a hearing aid, the user can use the telecoil to pick up the voice signals from a speaker through inductive coupling. Many hearing aid users prefer to use the telecoil mode in a hearing aid because the voice coupling is inductive rather than acoustic. By using the telecoil mode, the user can reduce the background acoustic noise and feedback that can occur when using a phone with a hearing aid in microphone mode (i.e., when using the microphone of the hearing aid to pick up and amplify the sounds generated by the speaker). Because telecoils installed in hearing aids are physically small, the magnetic flux from a wireless handset speaker must be of sufficient strength to allow the hearing aid user to inductively couple to the voice signals.

Hearing aid users may experience audible interference when using a digital wireless telephone due to Electromagnetic Interference (EMI) from the phone. When EMI occurs in a hearing aid, it can produce an audible buzz that can make understanding speech difficult, communication over wireless phones annoying and—in the most severe cases—render the phone completely unusable to the hearing aid wearer. Fluorescent lights, electric toasters, electric motors and digital wireless telephones are examples of devices that can generate EMI, which then can be picked up by the telecoil in a hearing aid.

In the case of digital wireless phones, the EMI may be caused by several sources. One such source is the RF transmission envelope of a digital wireless phone. For example, a digital wireless transmission phone that employs a TDMA (Time Division Multiple Access) RF envelope, in which the RF Transmitter is turned on and off, generates a time varying RF field that appears as a pulsing field. This pulsing field can induce currents within the hearing aid, thereby producing an audible buzz. In addition, other components within the digital wireless telephone from the wireless phone's electronic elements such as its backlighting, display, keypad, battery and circuit board produce EMI, which can be picked up by the telecoil.

The Federal Communications Commission (FCC) requires that each digital wireless phone manufacturer provide wireless carriers with at least two commercially available wireless phone models that provide telecoil (e.g., magnetic) coupling capability for each wireless transmission technology. In addition, the FCC will require that wireless phones be tested for their telecoil coupling capability according to the ANSI C63.19 standard, which is incorporated herein by reference in its entirety. Wireless phone are considered passing (those with a rating of "good" or "excellent") for use with hearing aids set in telecoil mode will be assigned a HAC (Hearing Aid Compatibility) rating of T3 or higher. The "T" is the designation for telecoil so that consumers will know the phone has been tested and rated for inductive coupling. The higher the "T" rating, the less likely the hearing aid user will experience interference when the hearing aid is set in the telecoil mode while using the wireless phone.

SUMMARY

In view of the above shortcomings and drawbacks, a speaker assembly, a method for manufacturing a speaker assembly and a wireless device are provided. Such a speaker assembly may include a diaphragm for generating sound, a transducer for causing the diaphragm to generate sound and an integrated inductive element that is electrically connected to the transducer. The diaphragm, transducer and integrated inductive element are contained within the speaker assembly. In such a method, a diaphragm, transducer and integrated inductive element are provided. The diaphragm and transducer are operatively coupled, and the integrated inductive element is electrically connected to the transducer. Such a wireless device may include a diaphragm that generates sound and a permanent magnet wound by a coil, where the permanent magnet causes the diaphragm to generate sound. In addition, the wireless device may include an inductive element that is electrically connected to the coil, where the diaphragm, the permanent magnet and the inductive element are contained within a speaker assembly of the wireless device, and where the inductive element is oriented to magnetically couple with an external telecoil.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings exemplary constructions of the invention; however, the invention is not limited to the specific methods and instrumentalities disclosed. In the drawings.

DETAILED DESCRIPTION

The subject matter of the various embodiments is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Example Embodiments

The disclosed embodiments describe a hearing aid compatible speaker that may be used within an analog wireless, digital wireless or wireline telephone handset, for example, to provide inductive coupling of audio signals to a hearing aid having a telecoil. Such embodiments may increase the strength of the inductive field generated by the speaker to facilitate inductive coupling with the telecoil. In addition, such embodiments provide a solution to overcoming the problem of EMI in handsets by increasing the desired inductive signal.

Figure 1A:
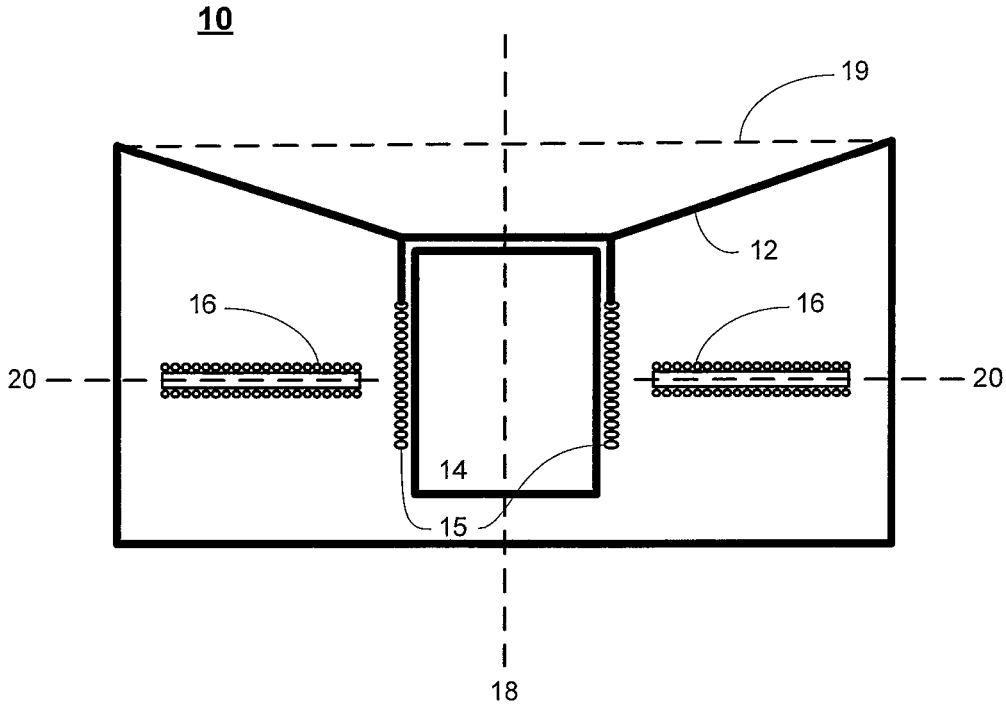
FIG. 1A is a diagram of a speaker assembly having an integrated telecoil according to an embodiment.

Referring to FIG. 1A, there is illustrated an example speaker assembly 10 having diaphragm 12, permanent magnet 14 wound by integrated speaker coil 15, and integrated inductive element 16 suitable for use in a confined space, such as that present in an analog or digital cellular telephone, a cordless telephone, a wireline telephone, etc. FIG. 1A is intended to illustrate an example cross-sectional view of speaker assembly 10. Optional speaker grill 19 may provide protection to diaphragm 12 and other components of speaker assembly 10. Although permanent magnet 14 is illustrated in FIG. 1A, any type of transducer may be used. For example, a piezoelectric element may be used in place of or in addition to permanent magnet 14, as will be discussed below. In one embodiment, speaker assembly 10 may be part of all of a micro speaker, or the like.

Inductive element 16 may be electrically coupled to audio speaker coil 15. As illustrated in FIG. 1A, speaker assembly 10, diaphragm 12, permanent magnet 14 and coil 15 are oriented along axis 18. It should be appreciated that speaker assembly 10, diaphragm 12, permanent magnet 14 and coil 15 may be oriented in any fashion, and that axis 18 may be oriented in any manner that is appropriate for the application for which such components are intended.

The electrical coupling of integrated inductive element 16 to integrated speaker coil 15 may be in a parallel, series, series/parallel fashion or the like. It can be seen in FIG. 1A that integrated inductive element 16 is integrated within speaker assembly 10. By using such a configuration, an embodiment uses approximately the same amount of space as is used by a conventional speaker assembly while also providing enhanced magnetic coupling as compared to such a conventional speaker assembly. Such a configuration according to an embodiment may reduce costs, accelerate time to market and reduce the likelihood of a redesign of the circuit board to which speaker assembly 10 is connected to meet the FCC telecoil requirement. It will be appreciated that, in an embodiment, additional components may be integrated into speaker assembly 10. For example, an amplifier (not shown) that drives inductive element 16 and/or coil 15 may be part of assembly 10.

Figure 1B:
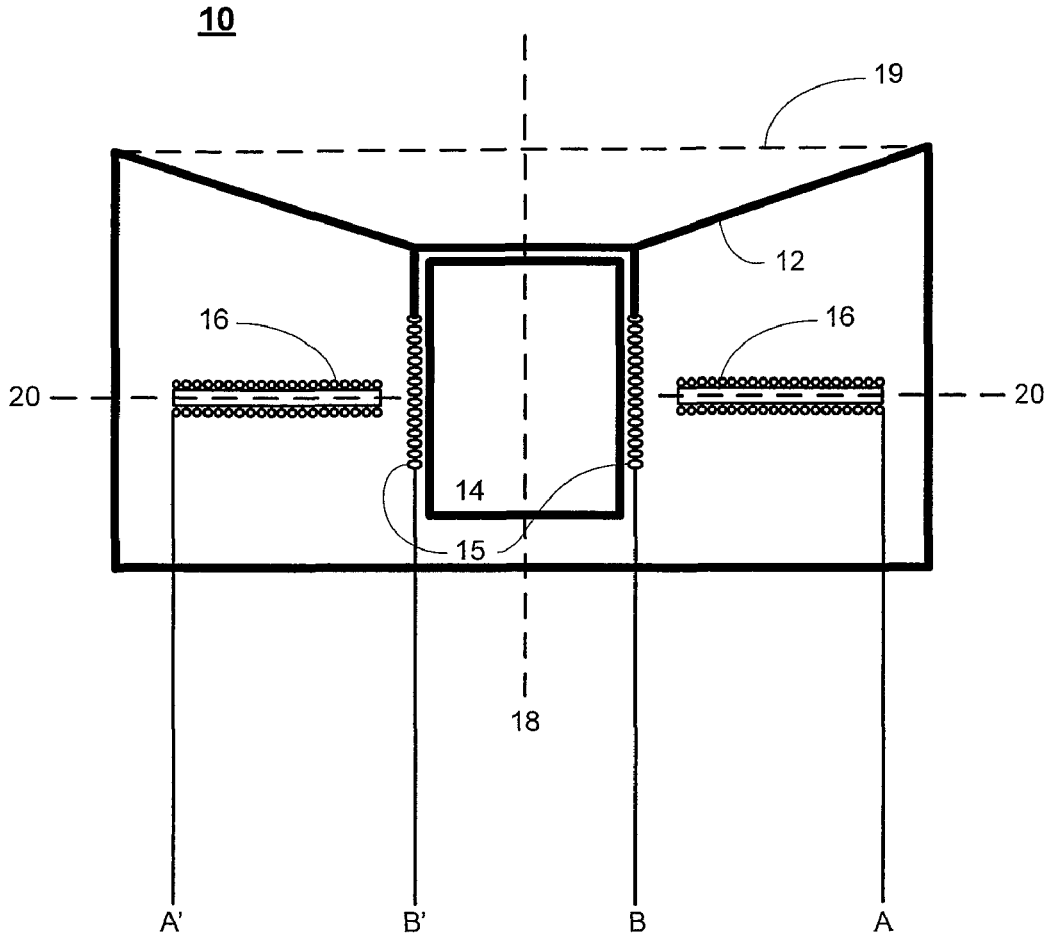
FIG. 1B is a diagram of a speaker assembly having an integrated telecoil having four-way separate inputs according to an embodiment.

Inductive element 16 is provided to generate magnetic field 20 that is, in an embodiment, produced in a desired direction to maximize the inductive coupling to a telecoil installed in a user's hearing aid that may be positioned in a given orientation. However, while inductive element 16 is shown at a 90 degree angle with respect to axis 18, inductive element 16 may be placed at other angles to enhance the magnetic field emanating from speaker assembly 10 in other orientations (e.g., aligned concentrically with inductive element 16, perpendicularly to inductive element 16, etc.) to that provided by magnet 14. Such angles may be determined based on, for example, telephone design, user characteristics and the like. Likewise, while FIG. 1B illustrates inductive element 16 as being arranged in a circular fashion around axis 18. It will be appreciated that inductive element 16 is shown in the cross-sectional view as two distinct components, but in the illustrated embodiment inductive element 16 is actually a single inductive element arranged around axis 18 (i.e., portions of inductive element 16 extend into and out of the page). While speaker assembly 10 is illustrated in FIGS. 1A-E as being circularly-configured (with respect to axis 18), it will be appreciated that speaker assembly 10 may be configured in any manner (e.g., rectangular, square, etc.) while remaining consistent with an embodiment.

In an embodiment, more than one inductive element 16 may be provided, as necessary to provide sufficient field strength or multiple orientations. Inductive element 16 may be located anywhere in speaker assembly 10. In one embodiment, inductive element 16 is located close to an output of diaphragm 12 to minimize the total separation distance between the telecoil in the hearing aid and inductive element 16. Such a reduction in the separation distance may increase the field strength of the desired voice signals presented to the telecoil in the hearing aid, thereby providing an improved voice signal to the hearing aid user.

In one embodiment, a piezoelectric element may be used in place of permanent magnet 14. Such a substitution may, for example, reduce the cost of fabricating speaker assembly 10 and reduce the amount of space required by speaker assembly 10. Piezoelectric speakers tend to have advantages over conventional speakers in that piezoelectric speakers require less space, have lower power consumption and are less expensive. Piezoelectric crystals produce an acoustical signal through a transduction of electrical energy and do not produce a magnetic field that can be coupled to a telecoil. As a result, an embodiment's inclusion of inductive element 16 provides a magnetic field suitable for inductive coupling with a hearing aid's telecoil.

It will be appreciated that speaker assembly 10, inductive element 16, audio speaker coil 15, diaphragm 12 and/or permanent magnet 14 may be connected and/or configured in any number of ways. Thus, FIGS. 1B-E illustrate various configurations of the speaker assembly 10 illustrated in FIG. 1A.

For example, and referring now to FIG. 1B, an example speaker assembly 10 having an integrated inductive element 16 and four-way separate inputs A, A', B and B' is depicted. Inputs A, A', B and B' may, in an embodiment, be any type of conductor, such as one or more wires or the like. As depicted in the embodiment illustrated in FIG. 1B (as well as in FIGS. 1C-E), inputs A and A' may be comprised of the same conductor. Likewise, inputs B and B' may be comprised of the same conductor. In such an embodiment, the difference between A and A', as well as between B and B', is used to refer to the input and return, respectively, of the conductor comprising A, A', B and B'.

Figure 1C:
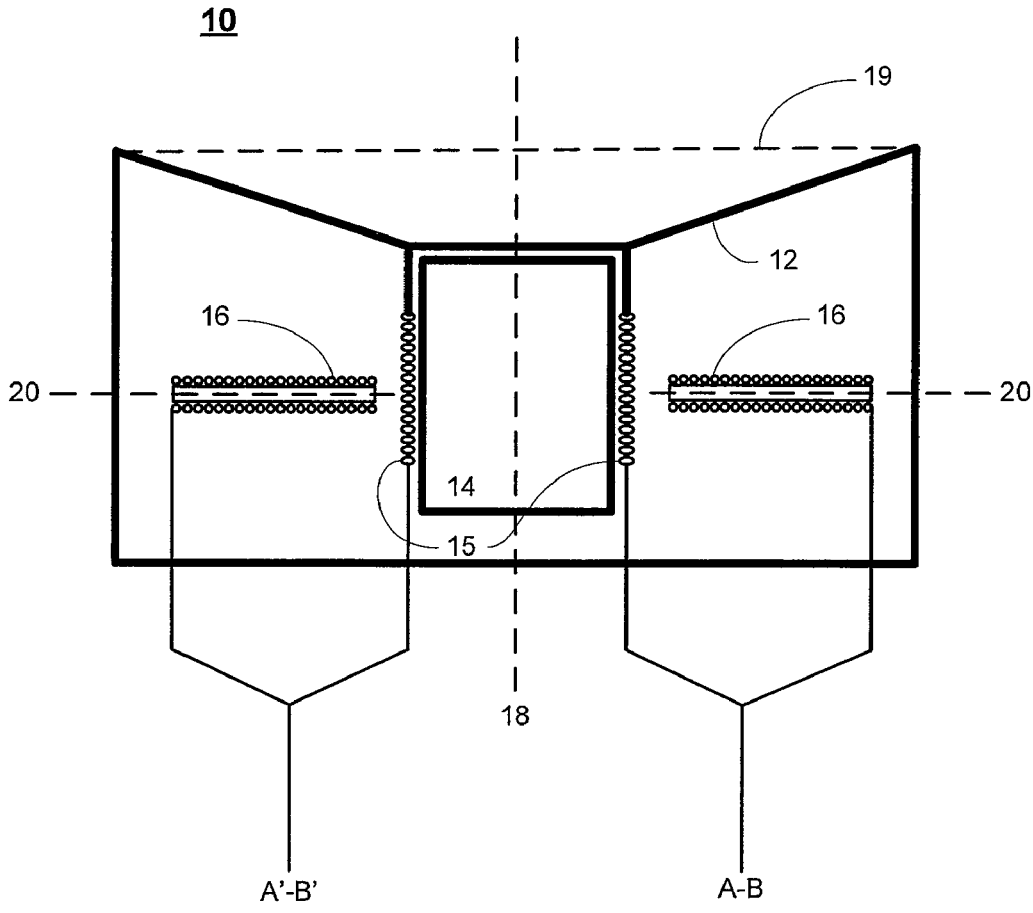
FIG. 1C is a diagram of a speaker assembly having an integrated telecoil having two-way parallel inputs according to an embodiment.

Referring now to FIG. 1C, an example speaker assembly 10 having an integrated inductive element 16 having two-way inputs A, A', B and B' configured in a parallel fashion according to an embodiment.

Figure 1D:
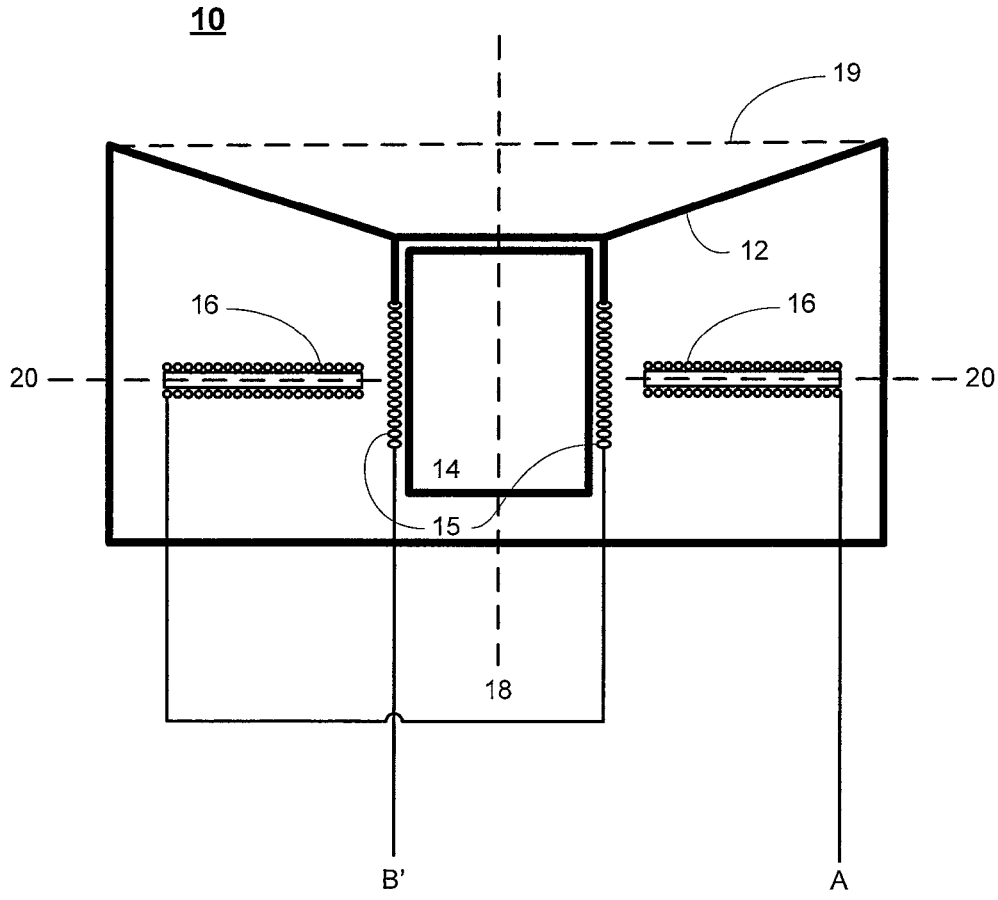
FIG. 1D is a diagram of a speaker assembly having an integrated telecoil having two way according to an embodiment.

Referring now to FIG. 1D, an example speaker assembly 10 having an integrated inductive element 16 having two-way inputs A, A', B and B' configured in a serial fashion according to an embodiment.

Figure 1E:
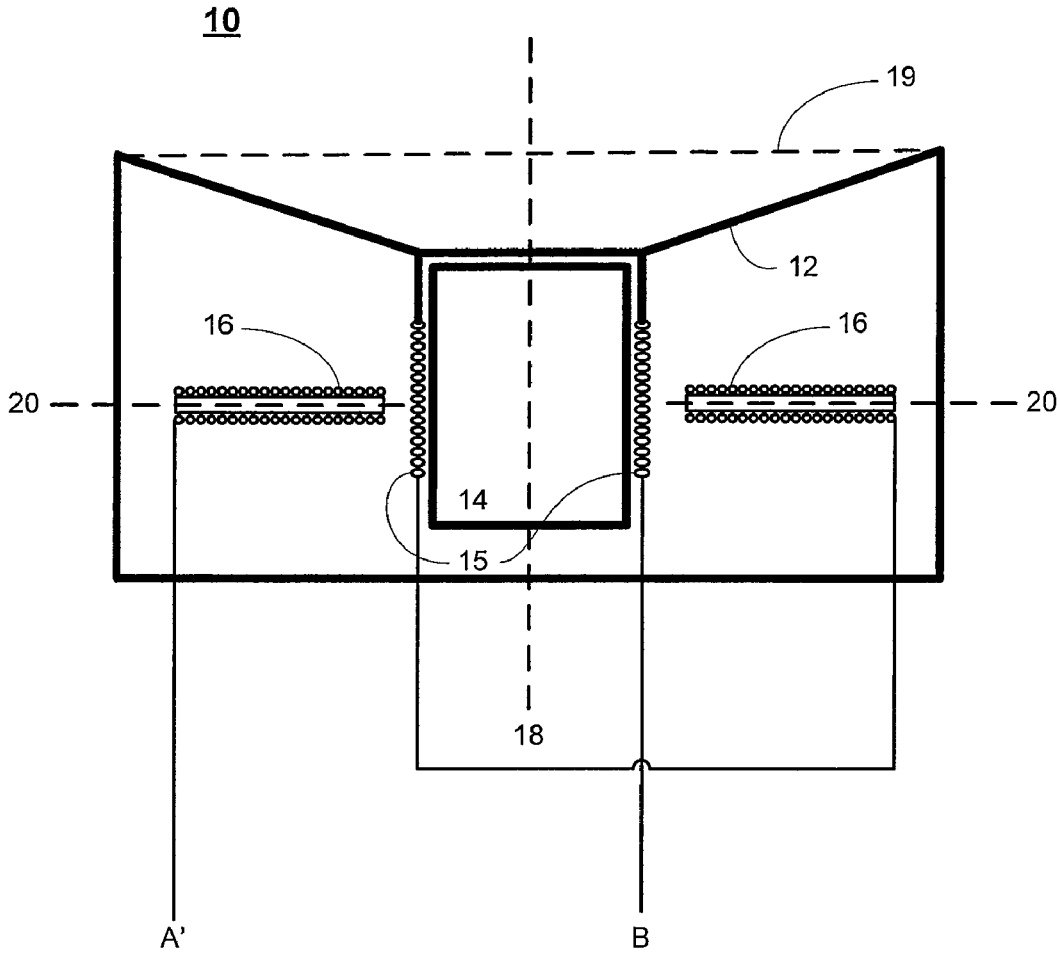
FIG. 1E is a diagram of a speaker assembly having an integrated telecoil having two-way serial inputs according to an embodiment.

Referring now to FIG. 1E, an example speaker assembly 10 having an integrated inductive element 16 having two-way inputs A, A', B and B' configured in an alternative serial fashion according to an embodiment.

Figure 2A:
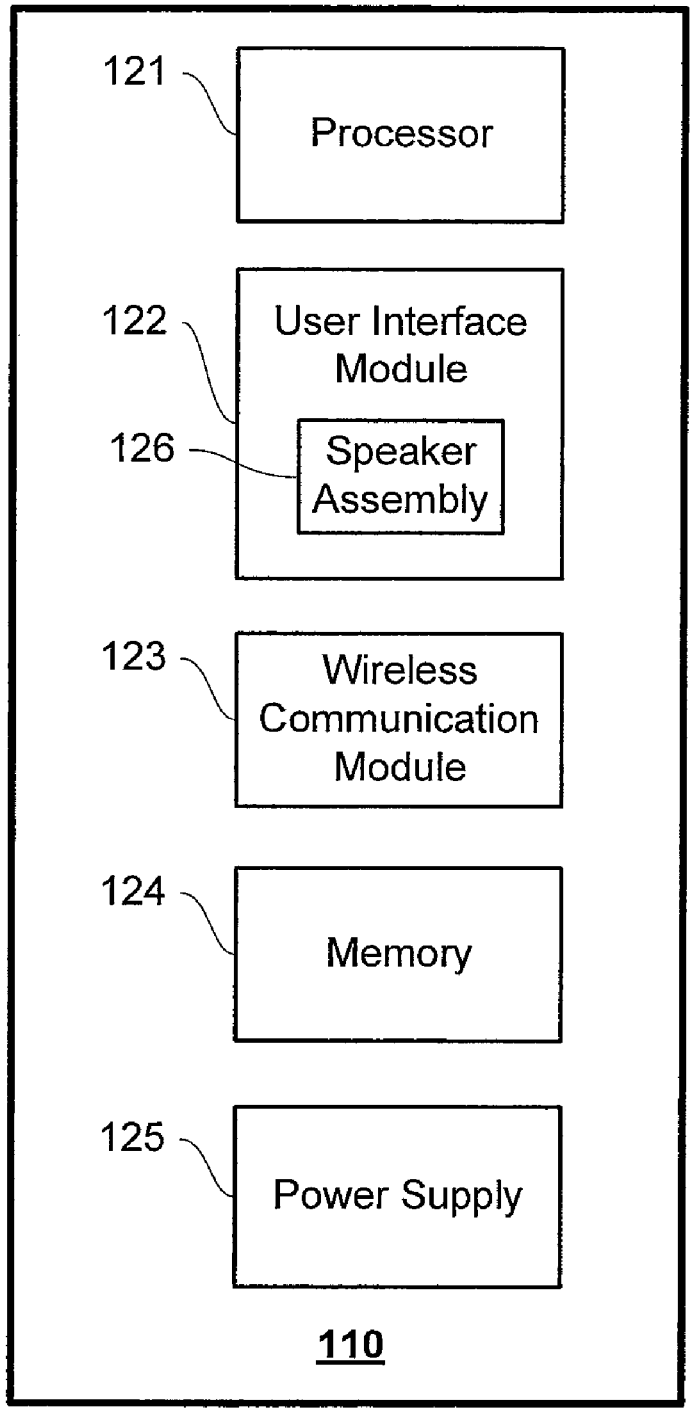
FIG. 2A illustrates an example wireless device that may be used in connection with an embodiment.

FIG. 2A illustrates an example wireless device 110 that may be used in connection with an embodiment. References will also be made to FIG. 1A as appropriate. It will be appreciated that the components and modules of wireless device 110 illustrated in FIG. 2A are illustrative, and that any number and type of components and/or modules may be present in wireless device 110. In addition, the functions performed by any or all of the components and modules illustrated in FIG. 2A may be performed by any number of physical components. Thus, it is possible that in some embodiments the functionality of more than one component and/or module illustrated in FIG. 2A may be performed by any number or types of hardware and/or software.

Processor 121 may be any type of circuitry that performs operations on behalf of wireless device 110. In one embodiment, processor 121 executes software (i.e., computer readable instructions stored in a computer readable medium). User interface module 122 may be any type or combination of hardware and/or software that enables user 101 to operate and interact with wireless device 110. For example, user interface module 122 may include a display, physical and "soft" keys, voice recognition software, microphone, speaker assembly 126 and the like. Speaker assembly 126 may be as was described above in connection with FIG. 1A. Wireless communication module 122 may be any type or combination of hardware and/or software that enables wireless device 110 to communicate with communication network 113. Memory 124 enables wireless device 110 to store information, such as fitness information 111 and the like. Memory 124 may take any form, such as internal random access memory (RAM), an SD card, a microSD card and the like. Power supply 125 may be a battery or other type of power input (e.g., a charging cable that is connected to an electrical outlet, etc.) that is capable of powering wireless device 110.

Figure 2B:
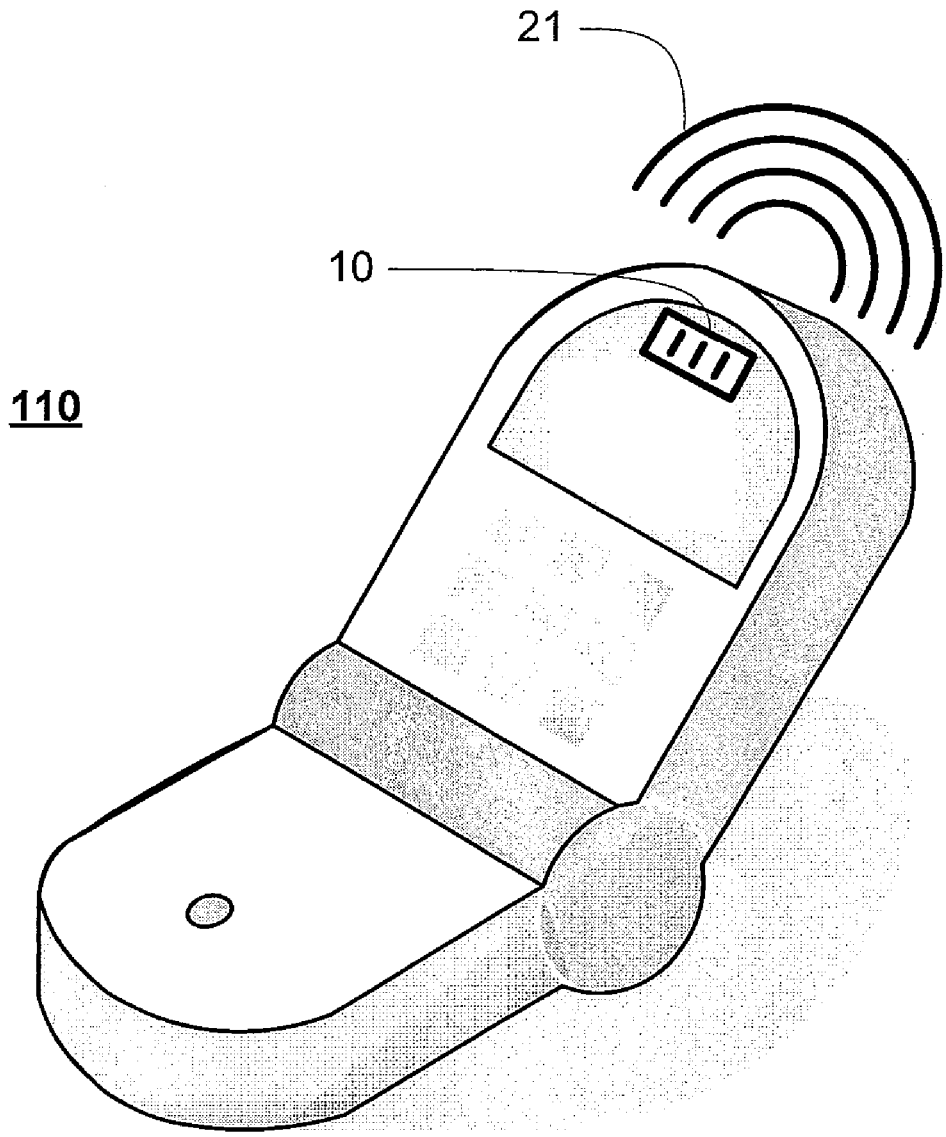
FIG. 2B illustrates an example wireless device having an integrated telecoil that may be used in connection with an embodiment.

FIG. 2B illustrates an example wireless device 110 having an example speaker assembly 10 in accordance with an embodiment. FIG. 2B depicts an example amplified magnetic field 21 that results from the use of speaker assembly 10. It will be appreciated that magnetic field 21 represents an electromagnetic signal corresponding to the audio being presented by speaker assembly 10.

Figure 2C:
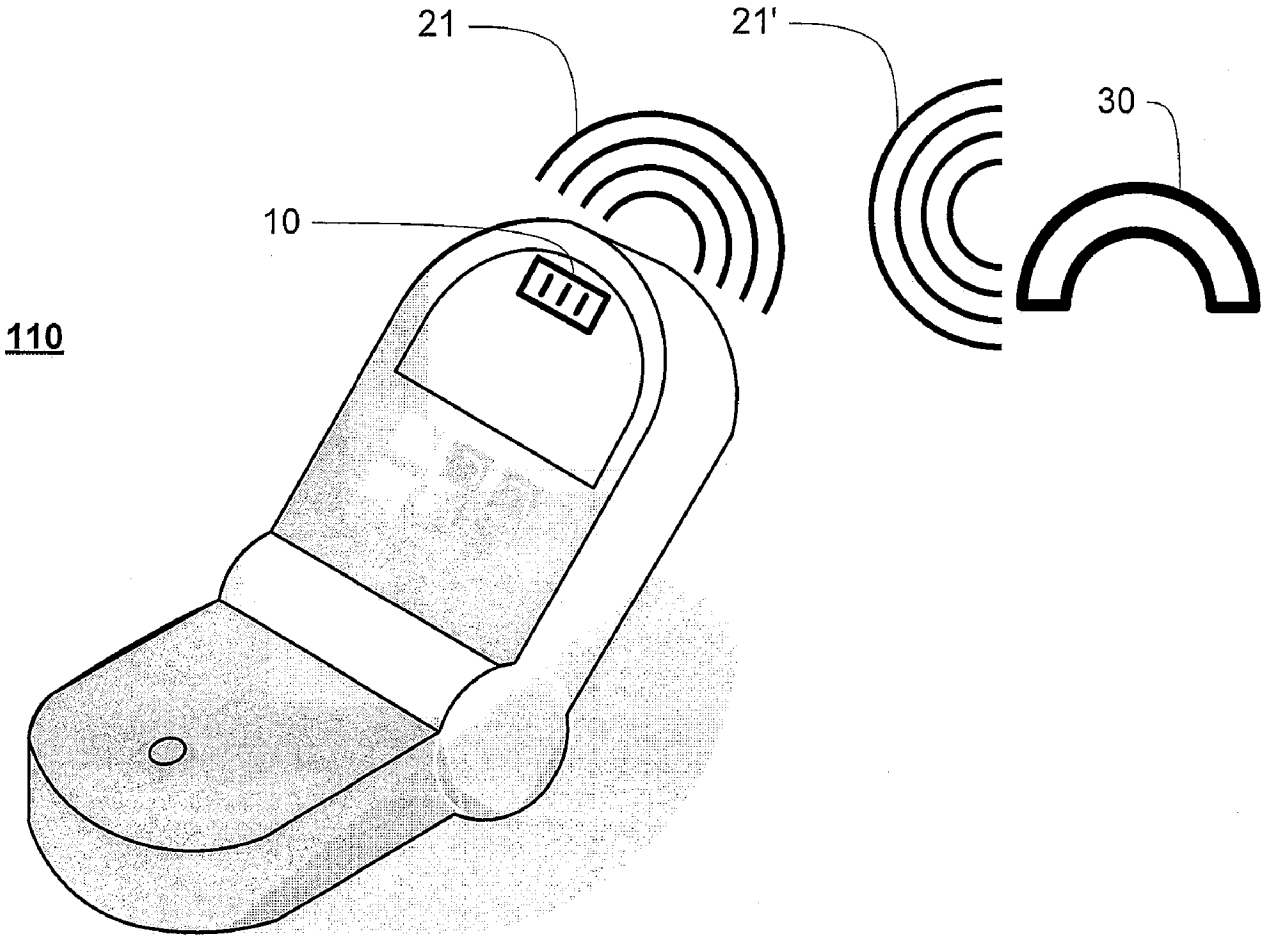
FIG. 2C illustrates an example wireless device having an integrated telecoil and a hearing assistance device that may be used in connection with an embodiment.

FIG. 2C again illustrates an example wireless device 110 having an example speaker assembly 10 in accordance with an embodiment. FIG. 2C depicts an example amplified magnetic field 21 that results from the use of speaker assembly 10. Hearing assistance device 30 picks up magnetic field 21' (which corresponds to magnetic field 21 as received by hearing assistance device 30) and reproduces the audio information represented by magnetic fields 21 and 21'.

Figure 3:
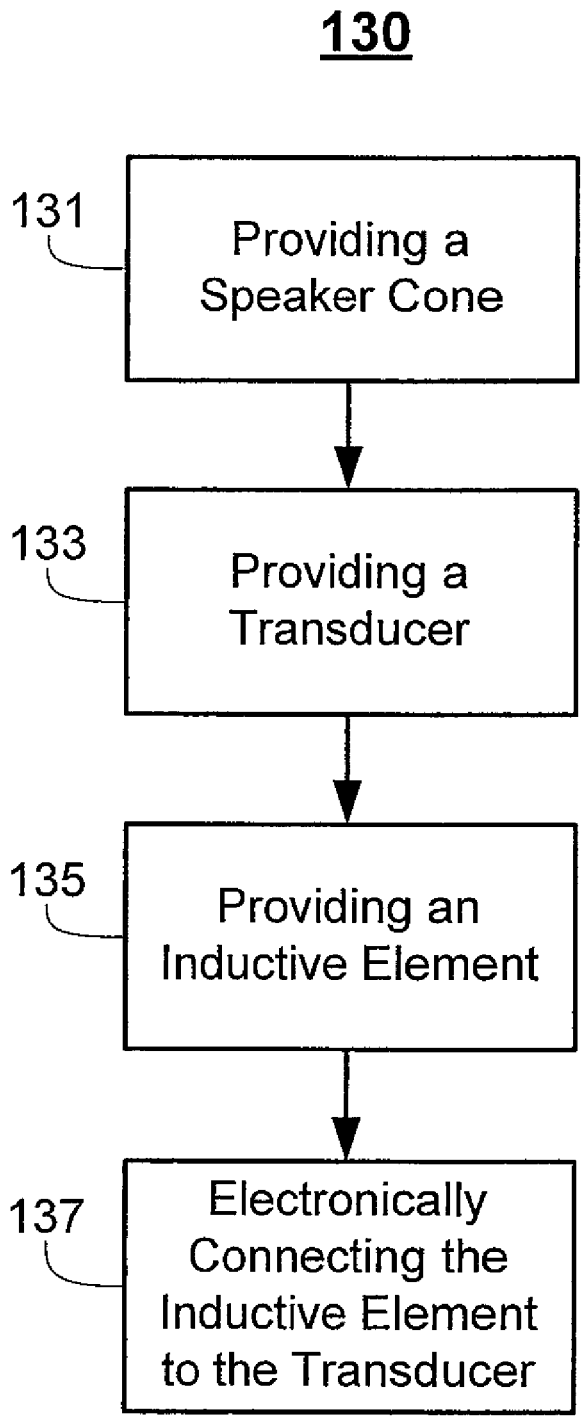
FIG. 3 is a flowchart illustrating an example manufacturing method according to an embodiment.

FIG. 3 is a flowchart illustrating an example manufacturing method 130 according to an embodiment. It will be appreciated that any type of manufacturing equipments or processes may be used to perform method 130. At 131, a diaphragm, such as diaphragm 12 as discussed above in connection with FIG. 1A, is provided. At 133, a transducer is provided and may be operatively coupled to the diaphragm. Such a transducer may be, for example, permanent magnet 14 as was discussed above in connection with FIG. 1A, a piezoelectric element, or the like.

At 135, an inductive element is provided such as, for example, inductive element 16 as was discussed above in connection with FIG. 1A. At 137, the inductive element is electronically connected to the transducer. As a result, a speaker having an integrated inductive element is created.

Example Network and Operating Environments

The following description sets forth some example telephony radio networks and non-limiting operating environments in which a handset having the above-described magnetic coupling enhanced speaker assembly according to an embodiment may be used. The below-described operating environments should be considered non-exhaustive, however, and thus the below-described network architecture merely shows an example network architecture in which aspects of various embodiments may be incorporated. One can appreciate, however, that aspects of an embodiment may be incorporated into now existing or future alternative architectures for communication networks.

The global system for mobile communication ("GSM") is one of the most widely-used wireless access systems in today's fast growing communication systems. GSM provides circuit-switched data services to subscribers, such as mobile telephone or computer users, for example. General Packet Radio Service ("GPRS"), which is an extension to GSM technology, introduces packet switching to GSM networks. GPRS uses a packet-based wireless communication technology to transfer high and low speed data and signaling in an efficient manner. GPRS optimizes the use of network and radio resources, thus enabling the cost effective and efficient use of GSM network resources for packet mode applications. For purposes of explanation, various embodiments are described herein in connection with GSM. The references to GSM are not exclusive, however, as it should be appreciated that embodiments may be implemented in connection with any type of wireless access system such as, for example, CDMA or the like.

As may be appreciated, the example GSM/GPRS environment and services described herein can also be extended to 3G services, such as Universal Mobile Telephone System ("UMTS"), Frequency Division Duplexing ("FDD") and Time Division Duplexing ("TDD"), High Speed Packet Data Access ("HSPDA"), cdma2000 1x Evolution Data Optimized ("EVDO"), Code Division Multiple Access-2000 ("cdma2000 3x"), Time Division Synchronous Code Division Multiple Access ("TD-SCDMA"), Wideband Code Division Multiple Access ("WCDMA"), Enhanced Data GSM Environment ("EDGE"), International Mobile Telecommunications-2000 ("IMT-2000"), Digital Enhanced Cordless Telecommunications ("DECT"), etc., as well as to other network services that shall become available in time. In this regard, the techniques of the various embodiments discussed below may be applied independently of the method of data transport, and does not depend on any particular network architecture, or underlying protocols.

Figure 4A:
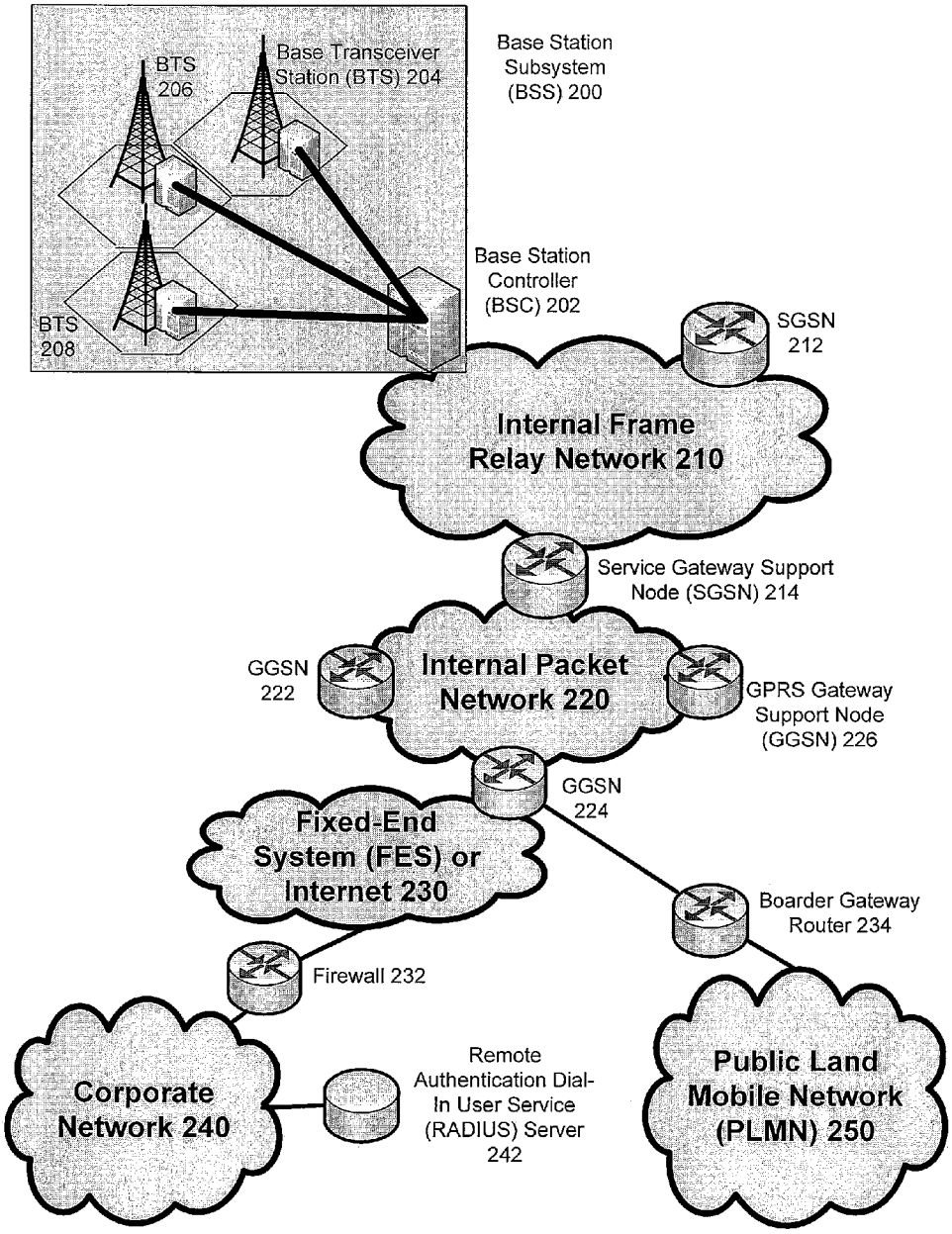
FIG. 4A illustrates an overview of a network environment in which aspects of an embodiment may be implemented.

FIG. 4A depicts an overall block diagram of an example packet-based mobile cellular network environment, such as a GPRS network, in which aspects of an embodiment may be practiced. In such an environment, there may be any number of subsystems that implement the functionality of the environment such as, for example, a plurality of Base Station Subsystems ("BSS") 200 (only one is shown in FIG. 4A), each of which comprises a Base Station Controller ("BSC") 202 serving a plurality of Base Transceiver Stations ("BTS") such as, for example, BTSs 204, 206 and 208. BTSs 204, 206, 208, etc., are the access points where users of packet-based mobile devices become connected to the wireless network. In one embodiment, the packet traffic originating from user devices is transported over the air interface to BTS 208, and from BTS 208 to BSC 202. Base station subsystems, such as BSS 200, may be a part of internal frame relay network 210 that may include Service GPRS Support Nodes ("SGSN") such as SGSN 212 and 214. Each SGSN 212, 214, etc. is in turn connected to internal packet network 220 through which SGSN 212, 214, etc. can route data packets to and from a plurality of gateway GPRS support nodes (GGSN) 222, 224, 226, etc. As illustrated, SGSN 214 and GGSNs 222, 224 and 226 are part of internal packet network 220. Gateway GPRS serving nodes 222, 224 and 226 may provide an interface to external Internet Protocol ("IP") networks such as Public Land Mobile Network ("PLMN") 250, corporate intranets 240, Fixed-End System ("FES"), the public Internet 230 or the like. As illustrated, subscriber corporate network 240 may be connected to GGSN 224 via firewall 232; and PLMN 250 may be connected to GGSN 224 via boarder gateway router 234. Remote Authentication Dial-In User Service ("RADIUS") server 242 may be used for caller authentication when a user of a mobile cellular device calls corporate network 240, for example.

Generally, there can be four different cell sizes in a GSM network—macro, micro, pico and umbrella cells. The coverage area of each cell is different in different environments. Macro cells may be regarded as cells where the base station antenna is installed in a mast or a building above average roof top level. Micro cells are cells whose antenna height is under average roof top level; they are typically used in urban areas. Pico cells are small cells having a diameter is a few dozen meters; they are mainly used indoors. On the other hand, umbrella cells are used to cover shadowed regions of smaller cells and fill in gaps in coverage between those cells.

Figure 4B:
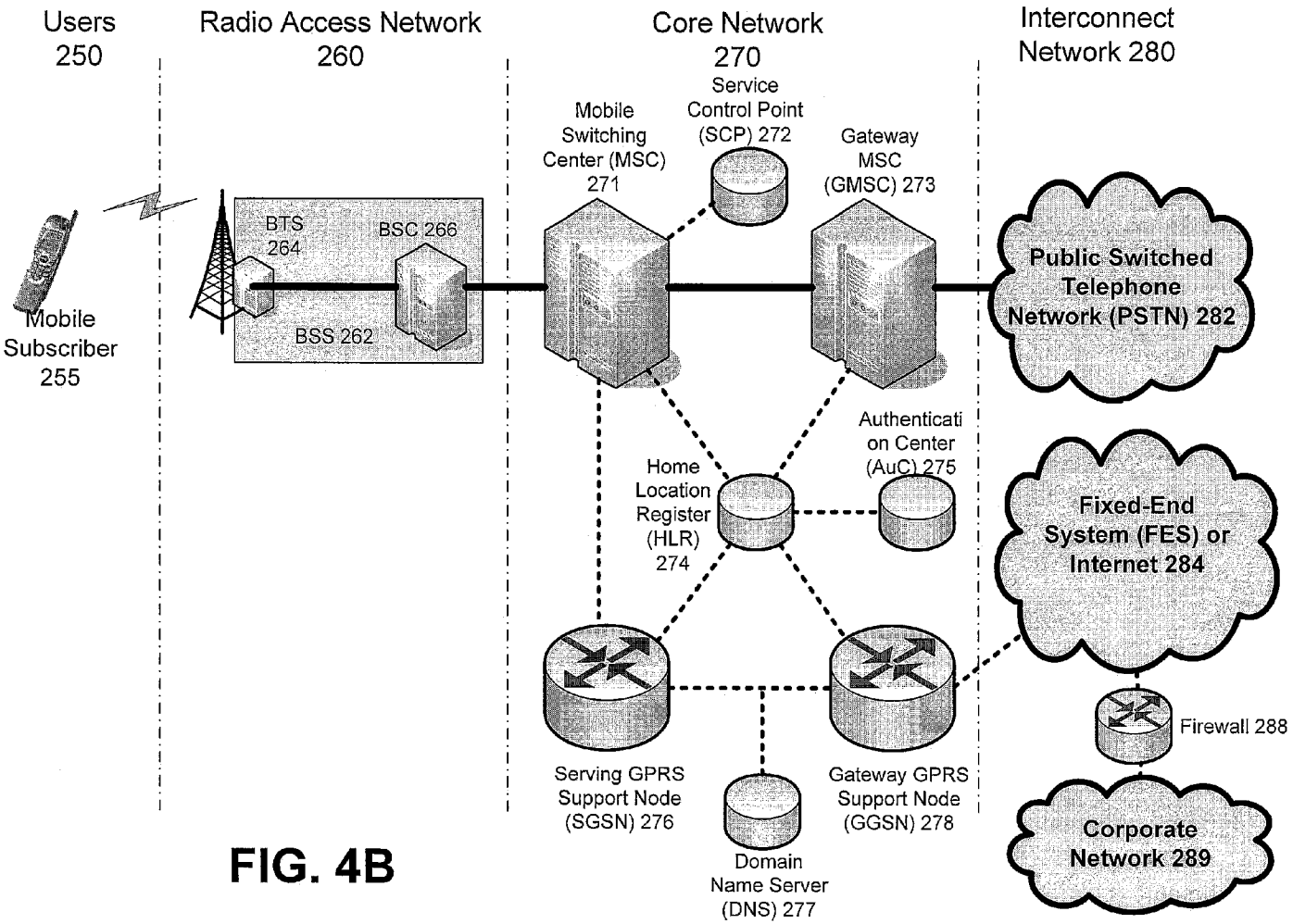
FIG. 4B illustrates a GPRS network architecture in which aspects of an embodiment may be implemented.

FIG. 4B illustrates the architecture of a typical GPRS network as segmented into four groups: users 250, radio access network 260, core network 270 and interconnect network 280. Users 250 comprise a plurality of end users (though only mobile subscriber 255 is shown in FIG. 4B). Radio access network 260 comprises a plurality of base station subsystems such as BSSs 262, which include BTSs 264 and BSCs 266. Core network 270 comprises a host of various network elements. As illustrated here, core network 270 may comprise Mobile Switching Center ("MSC") 271, Service Control Point ("SCP") 272, gateway MSC 273, SGSN 276, Home Location Register ("HLR") 274, Authentication Center ("AuC") 275, Domain Name Server ("DNS") 277 and GGSN 278. Interconnect network 280 also comprises a host of various networks and other network elements. As illustrated in FIG. 4B, interconnect network 280 comprises Public Switched Telephone Network ("PSTN") 282, Fixed-End System ("FES") or Internet 284, firewall 288 and Corporate Network 289.

A mobile switching center may be connected to a large number of base station controllers. At MSC 271, for example, depending on the type of traffic, the traffic may be separated such that voice may be sent to Public Switched Telephone Network ("PSTN") 282 through Gateway MSC ("GMSC") 273, and/or data may be sent to SGSN 276, which then sends the data traffic to GGSN 278 for further forwarding.

When MSC 271 receives call traffic, for example, from BSC 266, it may send a query to a database hosted by SCP 272. The SCP 272 processes the request and issues a response to MSC 271 so that it may continue call processing as appropriate.

HLR 274 is a centralized database for users to register to the GPRS network. HLR 274 stores static information about the subscribers such as the International Mobile Subscriber Identity ("IMSI"), subscribed services, and a key for authenticating the subscriber. HLR 274 also stores dynamic subscriber information such as the current location of the mobile subscriber. Associated with HLR 274 may be AuC 275. AuC 275 is a database that contains the algorithms for authenticating subscribers and includes the associated keys for encryption to safeguard the user input for authentication.

In the following, depending on context, the term "mobile subscriber" may refer to either the end user or to the actual portable device used by an end user of the mobile cellular service. When a mobile subscriber turns on his or her mobile device, the mobile device goes through an attach process by which the mobile device attaches to an SGSN of the GPRS network. Referring now to FIG. 4B, when mobile subscriber 255 initiates the attach process by turning on the network capabilities of the mobile device, an attach request is sent by mobile subscriber 255 to SGSN 276. The SGSN 276 queries another SGSN, to which mobile subscriber 255 was attached before, for the identity of mobile subscriber 255. Upon receiving the identity of mobile subscriber 255 from the other SGSN, SGSN 276 requests more information from mobile subscriber 255. This information is used to authenticate mobile subscriber 255 to SGSN 276 by HLR 274. Once verified, SGSN 276 sends a location update to HLR 274 indicating the change of location to a new SGSN, in this case SGSN 276. HLR 274 notifies the old SGSN, to which mobile subscriber 255 was attached, to cancel the location process for mobile subscriber 255. HLR 274 then notifies SGSN 276 that the location update has been performed. At this time, SGSN 276 sends an Attach Accept message to mobile subscriber 255, which in turn sends an Attach Complete message to SGSN 276.

After attaching itself with the network, mobile subscriber 255 then goes through the authentication process. In the authentication process, SGSN 276 sends the authentication information to HLR 274, which sends information back to SGSN 276 based on the user profile that was part of the user's initial setup. SGSN 276 then sends a request for authentication and ciphering to mobile subscriber 255. Mobile subscriber 255 uses an algorithm to send the user identification (ID) and password to SGSN 276. SGSN 276 uses the same algorithm and compares the result. If a match occurs, SGSN 276 authenticates mobile subscriber 255.

Next, mobile subscriber 255 establishes a user session with the destination network, corporate network 289, by going through a Packet Data Protocol ("PDP") activation process. Briefly, in the process, mobile subscriber 255 requests access to the Access Point Name ("APN"), for example, UPS.com (e.g., which can be corporate network 279) and SGSN 276 receives the activation request from mobile subscriber 255. SGSN 276 then initiates a Domain Name Service ("DNS") query to learn which GGSN node has access to the UPS.com APN. The DNS query is sent to the DNS server within the core network 270, such as DNS 277, which is provisioned to map to one or more GGSN nodes in the core network 270. Based on the APN, the mapped GGSN 278 can access the requested corporate network 279. The SGSN 276 then sends to GGSN 278 a Create Packet Data Protocol ("PDP") Context Request message that contains necessary information. The GGSN 278 sends a Create PDP Context Response message to SGSN 276, which then sends an Activate PDP Context Accept message to mobile subscriber 255.

Once activated, data packets of the call made by mobile subscriber 255 can then go through radio access network 260, core network 270, and interconnect network 280, in particular fixed-end system or Internet 284 and firewall 288, to reach corporate network 289.

Thus, network elements that may implicate the functionality of the service delivery based on real-time performance requirement(s) in accordance with an embodiment may include but are not limited to Gateway GPRS Support Node tables, Fixed End System router tables, firewall systems, VPN tunnels and any number of other network elements as required by the particular digital network.

Figure 4C:
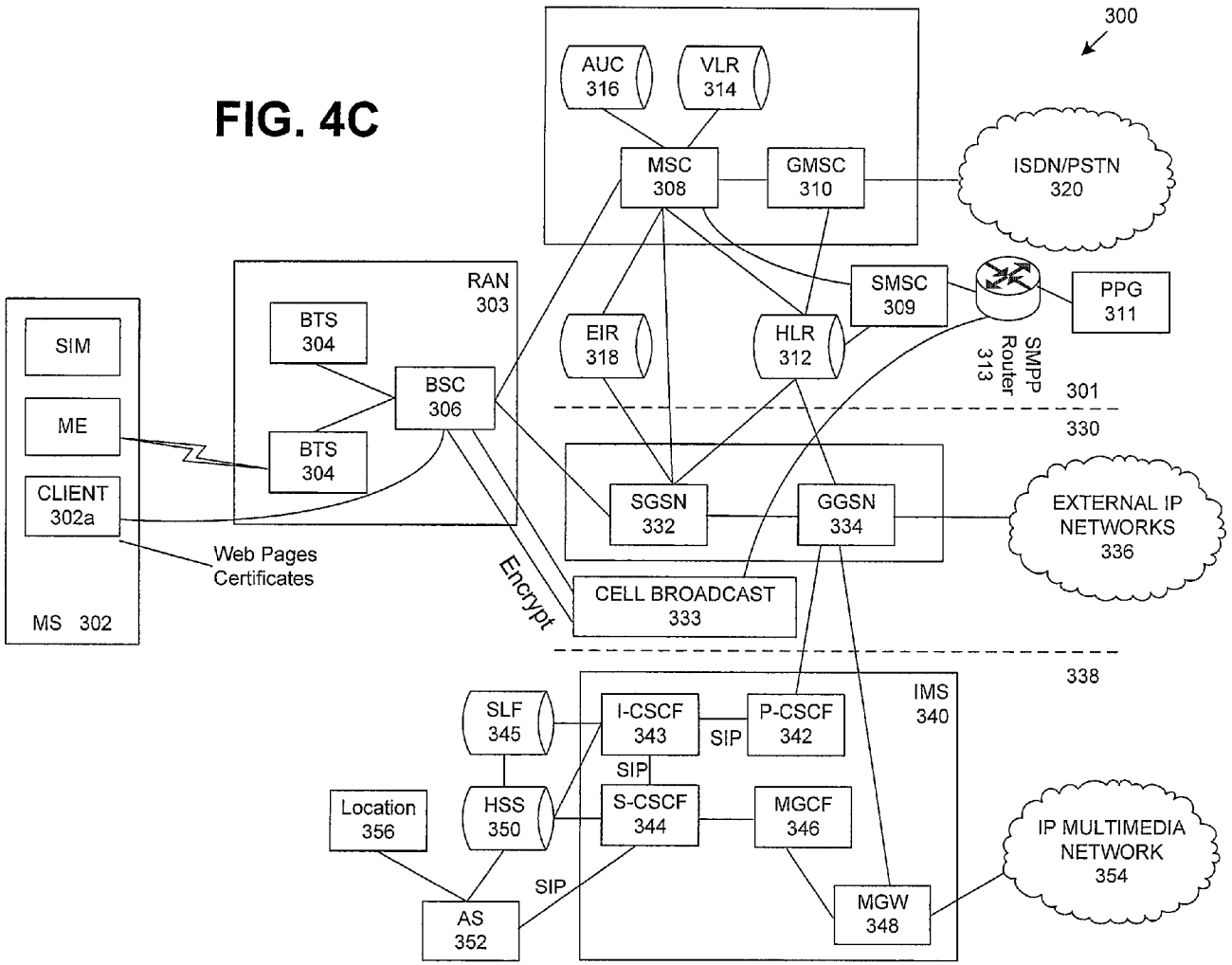
FIG. 4C illustrates an alternate block diagram of an example GSM/GPRS/IP multimedia network architecture in which aspects of an embodiment may be implemented.

FIG. 4C shows another example block diagram view of a GSM/GPRS/IP multimedia network architecture 300 in which the apparatus and methods for transferring multimedia content between receiving devices of the below-discussed embodiments may be incorporated. As illustrated, architecture 300 of FIG. 4C includes GSM core network 301, GPRS network 330 and IP multimedia network 338. GSM core network 301 includes Mobile Station (MS) 302, at least one Base Transceiver Station (BTS) 304 and Base Station Controller (BSC) 306. MS 302 is physical equipment or Mobile Equipment (ME), such as a mobile phone or a laptop computer that is used by mobile subscribers, with a Subscriber identity Module (SIM). The SIM includes an International Mobile Subscriber Identity (IMSI), which is a unique identifier of a subscriber. BTS 304 is physical equipment, such as a radio tower, that enables a radio interface to communicate with the MS. Each BTS may serve more than one MS. BSC 306 manages radio resources, including the BTS. The BSC may be connected to several BTSs. The BSC and BTS components, in combination, are generally referred to as a base station (BSS) or radio access network (RAN) 303.

GSM core network 301 also includes Mobile Switching Center (MSC) 308, Gateway Mobile Switching Center (GMSC) 310, Home Location Register (HLR) 312, Visitor Location Register (VLR) 314, Authentication Center (AuC) 318 and Equipment Identity Register (EIR) 316. MSC 308 performs a switching function for the network. The MSC also performs other functions, such as registration, authentication, location updating, handovers and call routing. GMSC 310 provides a gateway between the GSM network and other networks, such as an Integrated Services Digital Network (ISDN) or Public Switched Telephone Networks (PSTNs) 320. In other words, GMSC 310 provides interworking functionality with external networks.

HLR 312 is a database that contains administrative information regarding each subscriber registered in a corresponding GSM network. HLR 312 also contains the current location of each MS. VLR 314 is a database that contains selected administrative information from HLR 312. The VLR contains information necessary for call control and provision of subscribed services for each MS currently located in a geographical area controlled by the VLR. HLR 312 and VLR 314, together with MSC 308, provide the call routing and roaming capabilities of GSM. AuC 316 provides the parameters needed for authentication and encryption functions. Such parameters allow verification of a subscriber's identity. EIR 318 stores security-sensitive information about the mobile equipment.

Short Message Service Center (SMSC) 309 allows one-to-one Short Message Service (SMS) messages to be sent to/from MS 302. Push Proxy Gateway (PPG) 311 is used to "push" (i.e., send without a synchronous request) content to MS 102. PPG 311 acts as a proxy between wired and wireless networks to facilitate pushing of data to MS 302. Short Message Peer to Peer (SMPP) protocol router 313 is provided to convert SMS-based SMPP messages to cell broadcast messages. SMPP is a protocol for exchanging SMS messages between SMS peer entities such as short message service centers. It is often used to allow third parties, e.g., content suppliers such as news organizations, to submit bulk messages.

To gain access to GSM services, such as speech, data, and short message service (SMS), the MS first registers with the network to indicate its current location by performing a location update and IMSI attach procedure. MS 302 sends a location update including its current location information to the MSC/VLR, via BTS 304 and BSC 306. The location information is then sent to the MS's HLR. The HLR is updated with the location information received from the MSC/VLR. The location update also is performed when the MS moves to a new location area. Typically, the location update is periodically performed to update the database as location updating events occur.

GPRS network 330 is logically implemented on the GSM core network architecture by introducing two packet-switching network nodes, a serving GPRS support node (SGSN) 332, a cell broadcast and a Gateway GPRS support node (GGSN) 334. SGSN 332 is at the same hierarchical level as MSC 308 in the GSM network. The SGSN controls the connection between the GPRS network and MS 302. The SGSN also keeps track of individual MS's locations and security functions and access controls.

Cell Broadcast Center (CBC) 333 communicates cell broadcast messages that are typically delivered to multiple users in a specified area. Cell Broadcast is one-to-many geographically focused service. It enables messages to be communicated to multiple mobile phone customers who are located within a given part of its network coverage area at the time the message is broadcast.

GGSN 334 provides a gateway between the GPRS network and a public packet network (PDN) or other IP networks 336. That is, the GGSN provides interworking functionality with external networks, and sets up a logical link to the MS through the SGSN. When packet-switched data leaves the GPRS network, it is transferred to external TCP-IP network 336, such as an X.25 network or the Internet. In order to access GPRS services, the MS first attaches itself to the GPRS network by performing an attach procedure. The MS then activates a packet data protocol (PDP) context, thus activating a packet communication session between the MS, the SGSN, and the GGSN.

In a GSM/GPRS network, GPRS services and GSM services can be used in parallel. The MS can operate in one three classes: class A, class B, and class C. A class A MS can attach to the network for both GPRS services and GSM services simultaneously. A class A MS also supports simultaneous operation of GPRS services and GSM services. For example, class A mobiles can receive GSM voice/data/SMS calls and GPRS data calls at the same time.

A class B MS can attach to the network for both GPRS services and GSM services simultaneously. However, a class B MS does not support simultaneous operation of the GPRS services and GSM services. That is, a class B MS can only use one of the two services at a given time.

A class C MS can attach for only one of the GPRS services and GSM services at a time. Simultaneous attachment and operation of GPRS services and GSM services is not possible with a class C MS.

GPRS network 330 can be designed to operate in three network operation modes (NOM1, NOM2 and NOM3). A network operation mode of a GPRS network is indicated by a parameter in system information messages transmitted within a cell. The system information messages dictates a MS where to listen for paging messages and how signal towards the network. The network operation mode represents the capabilities of the GPRS network. In a NOM1 network, a MS can receive pages from a circuit switched domain (voice call) when engaged in a data call. The MS can suspend the data call or take both simultaneously, depending on the ability of the MS. In a NOM2 network, a MS may not received pages from a circuit switched domain when engaged in a data call, since the MS is receiving data and is not listening to a paging channel In a NOM3 network, a MS can monitor pages for a circuit switched network while received data and vise versa.

IP multimedia network 338 was introduced with 3GPP Release 5, and includes IP multimedia subsystem (IMS) 340 to provide rich multimedia services to end users. A representative set of the network entities within IMS 340 are a call/session control function (CSCF), media gateway control function (MGCF) 346, media gateway (MGW) 348, and a master subscriber database, referred to as a home subscriber server (HSS) 350. HSS 350 may be common to GSM network 301, GPRS network 330 as well as IP multimedia network 338.

IP multimedia system 340 is built around the call/session control function, of which there are three types: interrogating CSCF (I-CSCF) 343, proxy CSCF (P-CSCF) 342 and serving CSCF (S-CSCF) 344. P-CSCF 342 is the MS's first point of contact with IMS 340. P-CSCF 342 forwards session initiation protocol (SIP) messages received from the MS to an SIP server in a home network (and vice versa) of the MS. P-CSCF 342 may also modify an outgoing request according to a set of rules defined by the network operator (for example, address analysis and potential modification).

I-CSCF 343 forms an entrance to a home network and hides the inner topology of the home network from other networks and provides flexibility for selecting an S-CSCF. I-CSCF 343 may contact subscriber location function (SLF) 345 to determine which HSS 350 to use for the particular subscriber, if multiple HSSs 350 are present. S-CSCF 344 performs the session control services for MS 302. This includes routing originating sessions to external networks and routing terminating sessions to visited networks. S-CSCF 344 also decides whether application server (AS) 352 is required to receive information on an incoming SIP session request to ensure appropriate service handling. This decision is based on information received from HSS 350 (or other sources, such as application server 352). AS 352 also communicates to location server 356 (e.g., a Gateway Mobile Location Center (GMLC)) that provides a position (e.g., latitude/longitude coordinates) of MS 302.

HSS 350 contains a subscriber profile and keeps track of which core network node is currently handling the subscriber. It also supports subscriber authentication and authorization functions (AAA). In networks with more than one HSS 350, a subscriber location function provides information on HSS 350 that contains the profile of a given subscriber.

The MGCF 346 provides interworking functionality between SIP session control signaling from IMS 340 and ISUP/BICC call control signaling from the external GSTN networks (not shown). It also controls media gateway (MGW) 348 that provides user-plane interworking functionality (e.g., converting between AMR- and PCM-coded voice). MGW 348 also communicates with other IP multimedia networks 354.

Push to Talk over Cellular (PoC) capable mobile phones register with the wireless network when the phones are in a predefined area (e.g., job site, etc.). When the mobile phones leave the area, they register with the network in their new location as being outside the predefined area. This registration, however, may not indicate the actual physical location of the mobile phones outside the pre-defined area.

While the various embodiments have been described in connection with the preferred embodiments of the various figures, it is to be understood that other similar embodiments may be used or modifications and additions may be made to the described embodiment for performing the same function of the various embodiments without deviating therefrom. Therefore, the embodiments should not be limited to any single embodiment, but rather should be construed in breadth and scope in accordance with the appended claims.

What is claimed:

1. A speaker assembly comprising:
- a diaphragm for generating sound;
- a permanent magnet wound by a coil, wherein the permanent magnet causes the diaphragm to generate sound; and
- an inductive element that is electrically connected to the coil, wherein:
  - the inductive element, the diaphragm and the permanent magnet and contained within the speaker assembly; and
  - the inductive element is positioned to surround the permanent magnet and the coil and not surround the diaphragm;
  - the inductive element and the coil are integrated within the speaker assembly; and
  - the inductive element is oriented to magnetically couple with an external telecoil.

2. The speaker assembly of claim 1, wherein the inductive element is connected to the coil in parallel.

3. The speaker assembly of claim 1, wherein the inductive element is connected to the coil in series.

4. The speaker assembly of claim 1, wherein the inductive element generates a magnetic field in a direction to operatively couple with a telecoil that is external to the speaker assembly.

5. The speaker assembly of claim 4, wherein the inductive element is oriented at a substantially 90 degree angle with respect to the permanent magnet.

6. The speaker assembly of claim 4, wherein the inductive element is positioned proximate the diaphragm.

7. The speaker assembly of claim 1, wherein the speaker assembly forms at least a portion of a micro speaker.

8. A method comprising:
- electrically connecting an inductive element to a coil, wherein:
  - a permanent magnet is wound by the coil;
  - the permanent magnet causes a diaphragm to generate sound;
- orienting the inductive element to magnetically couple with an external telecoil;
- integrating the inductive element and the coil with a speaker assembly of a wireless device;
- positioning the inductive element to surround the permanent magnet and the coil and not surround the diaphragm; and
- containing the diaphragm, the permanent magnet, and the inductive element within the speaker assembly.

9. The method of claim 8, further comprising connecting the inductive element to the coil in parallel or in series.

10. The method of claim 8, further comprising orienting the inductive element at a 90 degree angle to the permanent magnet.

11. The method of claim 8, further comprising providing a plurality of inductive elements, each of the plural of inductive elements being provided at predetermined angles with respect to the permanent magnet.

12. The method of claim 8, further comprising positioning the inductive element proximate to the diaphragm.

13. A wireless device comprising:

a diaphragm that generates sound;

a permanent magnet wound by a coil, wherein the permanent magnet causes the diaphragm to generate sound; and an inductive element that is electrically connected to the coil, wherein:

the diaphragm, the permanent magnet and the inductive element are contained within a speaker assembly of the wireless device;

the inductive element is oriented to magnetically couple with an external telecoil;

the inductive element and the coil are integrated within the speaker assembly; and the inductive element is positioned to surround the permanent magnet and the coil and not surround the diaphragm.

14. The wireless device of claim 13, wherein the inductive element is electrically connected to the coil in parallel or in series.

15. The wireless device of claim 13, wherein the inductive element is oriented at a substantially 90 degree angle with respect to the permanent magnet.

16. The wireless device of claim 13, wherein the inductive element is positioned proximate the diaphragm.

* * * * *